US005367222A

United States Patent [19]

Binkley

[11] Patent Number: 5,367,222

[45] Date of Patent: Nov. 22, 1994

[54] REMOTE GAIN CONTROL CIRCUIT FOR PHOTOMULTIPLIER TUBES

[75] Inventor: David M. Binkley, Knox County, Tenn.

[73] Assignee: CTI Pet Systems, Inc., Knoxville, Tenn.

[21] Appl. No.: 69,773

[22] Filed: Jun. 1, 1993

[51] Int. Cl.[5] ..... H01J 29/41

[52] U.S. Cl. ..... 315/12.1; 313/533

[58] Field of Search ..... 315/12.1, 383; 250/214 VT, 214 AG, 207; 313/533

[56] References Cited

U.S. PATENT DOCUMENTS

| | | |
|---|---|---|
| 3,435,233 | 3/1969 | Farnsworth . |
| 3,437,817 | 4/1969 | Doonan . |
| 3,439,172 | 4/1969 | Chapman . |
| 3,446,972 | 5/1969 | Bentley et al. . |
| 3,714,441 | 1/1973 | Kreda . |
| 3,988,590 | 10/1976 | Johnson . |
| 4,590,368 | 5/1986 | Govaert . |
| 4,804,891 | 2/1989 | Sweeney . |
| 4,820,914 | 4/1989 | Allen . |
| 4,918,314 | 4/1990 | Sonne . |

OTHER PUBLICATIONS (Soviet reference not translated) Pribori i Technika Eksperimenta, vol. 5, No. 3, 1963, pp. 5–14.

V. V. Barkov et al., Sampled-Data Automatic Gain Control of a Photo-Multiplier, Pribori i Tekhnika Eksperimenta, Jul.-Aug. 1972, pp. 129–131.

V. N. Larionov et al., Automatic Gain Control System for the Photo-Multiplier in a High-Sensitivity Differential Spectrophotometer, Sov. J. Opt. Technology, vol. 51, Oct. 1984, pp. 591–595.

Machaj et al., Pulse Processing Automatic Gain Control Circuit for Multiplier Tube, Nukleonika-vol. 24-No. 5, 1979, pp. 549–559.

Alkhazov et al., Stabilization of Photomultiplier Gain of Liquid Scintillation Counter, Pribori i Tekhnika Eksperimenta, No. 5, Sep.-Oct. 1987, pp. 86–87.

Binon et al., Photomultiplier Gain Tuning System, Nuclear Instruments and Methods, vol. 214, 1983. pp. 269–272.

Mitsenko, I. D., Automatic Noise Gain Control Using an FEU-83 Photo-Multiplier, Pribori i Tekhnika Eksperimenta, No. 4, Jul.-Aug. 1970, pp. 193–194.

Martyushev et al., Efficient Circuit for the Automatic Regulation of Photomultiplier Sensitivity, Pribori i Tekhnika Eksperimenta, No. 1, Jan.-Feb. 1983, pp. 131–134.

Aver'yanov et al., Circuit for Automatic Control Gain of an FEU-83 Photomultiplier According to Noise Level, Pribori i Tekhnika Eksperimenta, No. 4, Jul.-Aug. 1976, pp. 191–192.

*Primary Examiner*—Theodore M. Blum
*Attorney, Agent, or Firm*—Pitts & Brittian

[57] ABSTRACT

A gain control circuit (10) for remotely controlling the gain of a photomultiplier tube (PMT (12)). The remote gain control circuit (10) may be used with a PMT (12) having any selected number of dynodes (DY). The remote gain control circuit (10) is connected to the last dynode nearest the anode (16) in the dynode string which controls the total dynode supply voltage and influences the gain of each dynode (DY). The remote gain control circuit (10) of the present invention includes an integrated-circuit operational amplifier (U1), a high-voltage transistor (Q1), a plurality of resistors (R), a plurality of capacitors (C), and a plurality of diodes (D). Negative feedback is used to set the last dynode voltage proportional to a voltage controlled by the gain control voltage delivered by a voltage source such as a digital-to-analog converter. The control circuit (10) of the present invention is connected to the last dynode using a single connecting wire (22).

21 Claims, 3 Drawing Sheets

REMOTE GAIN CONTROL CIRCUIT FOR PHOTOMULTIPLIER TUBES

TECHNICAL FIELD

This invention relates to the field of photomultiplier tubes. More specifically, the present invention relates to the remote control of the gain of photomultiplier tubes.

Background Art

Photomultiplier tubes (PMTs) are known to be sensitive light detectors. PMTs detect light photons at a photocathode and convert the detected photons to photoelectrons. The photoelectrons generally leave the cathode at a low velocity and are accelerated into a first dynode. When one electron hits a dynode, a plurality of electrons, generally four to five, are released from the dynode through a process known as secondary emission. The gain of the particular dynode is determined by the number of electrons released from the dynode for each electron which strikes it. The electrons released from the dynode are then accelerated toward the next successive dynode. These electrons are then multiplied by striking successive dynodes where additional electrons are released. Finally, the multiplied electrons are collected at the PMT anode resulting in an output signal current. The output current may be delivered across a resistive element or group of elements to create a voltage, or it could be delivered to a current amplifier.

It is well known that the electron-multiplication gain of a typical 10-stage, or 10-dynode PMT is approximately 10,000,000 with an electron-multiplication gain of five for each dynode. It is well known that such a high level of gain is available with high signal bandwidth and low added noise.

In a properly biased PMT, the voltage at the first dynode must be more positive than the cathode voltage and the voltage at each successive dynode must be more positive than the voltage at the previous dynode. Finally, the anode voltage must be more positive than the last dynode voltage. Such a biasing method is most commonly provided by a traditional resistive divider network such as the one shown in FIG. 1, which is a schematic diagram of a PMT with a prior art resistive divider. Although a negative PMT cathode voltage with the anode voltage at ground is shown in FIG. 1, it is also common practice to operate the cathode at ground voltage with the anode at a positive voltage.

In FIG. 1, the resistive divider network is a dynode bleeder string between the cathode and the anode. A cathode biasing network is connected to the cathode and an anode biasing network is connected to the anode for biasing each at a selected voltage. A resistive element is placed between each pair of successive dynodes, between the cathode biasing network and the first dynode, and between the last dynode and the anode biasing network. Resistors or zener dynodes may be used to provide the required voltage drops.

In the traditional PMT resistive divider bias network shown in FIG. 1, PMT gain can be varied by varying resistance values such that the voltage between a pair of dynodes is varied changing the multiplication gain of the affected dynode pair. This is illustrated in FIG. 1 where the voltage between the fourth and fifth dynode DY4 and DY5 is adjusted using potentiometer R5 with a limiting resistor R5' connected to its wiper. It is also possible to adjust gain by varying the voltage between the cathode and first dynode, although this can result in undesirable transit-time shift and a degradation in energy and timing resolution for applications where a scintillatot is coupled to the PMT cathode. For these reasons, the zener diodes D1 and D2 shown in FIG. 1 are sometimes used instead of a resistor R1 to maintain a fixed voltage between the cathode and first dynode. PMT gain may alternatively be adjusted by varying the total bias voltage between the anode and cathode using a cathode series resistance $R_C$.

It is well known that multiple gain-adjustment methods such as those described—e.g., changing the voltage between pairs of dynodes and changing the total bias voltage—can provide a wider gain adjustment range than that available using a single gain-adjustment method.

It is well known that the gain of the PMT will vary due to aging and temperature effects, or by changing characteristics of other system variables. In many systems, therefore, it is desirable to remotely control the PMT gain in order to compensate for the gain drift of the PMT. It is also desirable to control the gain of the PMT electronically. The prior art gain adjustment methods as described involve changing resistance values which cannot be easily implemented using remote gain-control circuits.

Several methods have been devised to remotely control the gain of the PMT. Typical of the art are those devices disclosed in the following U.S. Patents:

| Pat. No. | Inventor(s) | Issue Date |
|---|---|---|
| 3,435,233 | R. P. Farnsworth | Mar 25, 1969 |
| 3,437,817 | D. D. Doonan | Apr 8, 1969 |
| 3,439,!72 | T. H. Chapman | Apr 15, 1969 |
| 3,446,972 | G. P. Bentley, et al. | May 27, 1969 |
| 3,714,441 | E. J. Kreda | Jan 30, 1973 |
| 3,988,590 | W. F. Johnson | Oct 26, 1976 |
| 4,590,368 | J. A. Govaert | May 20, 1986 |
| 4,804,891 | H. E. Sweeney | Feb 14, 1989 |
| 4,820,914 | R. J. Allen | Apr 11, 1989 |
| 4,918,314 | D. S. Sonne | Apr 17, 1990 |

One typical method of remotely controlling the gain of a PMT involves changing the total PMT bias voltage for the particular bias network such as that shown in FIG. 1. The Kreda ('441), Johnson ('590), Govaert ('368), and Sonne ('314) devices are exemplary of this method. These gain-control methods require the adjustment of the high-voltage (typically over 1000 V) required for biasing a PMT, which cannot be easily done using low-cost integrated-circuit and transistor components. Similar systems where PMT gain is controlled by varying total bias voltage are disclosed by Barkov, V. V., et al, "Sampled-Data Automatic Gain Control of a Photomultiplier," *Pribory i Tekhnika Eksperimenta*, No. 4, July-August, 1972, pp. 129–131; Larionov, V. N., and A. A. Tobolov, "Automatic gain control system for the photomultiplier (PMT) in a high-sensitivity differential spectrophotometer," *Sov. J. Opt. Technol.*, Vol. 51, No. 10, October 1984, pp. 591–595; Machaj, B., et al, "Pulse Processing Automatic Gain Control Circuit for Photomultiplier Tube," *Nukleonika*, Vol. 24, No. 5, 1979, pp. 549–559; Alkhazov, I. D., et al, "Stabilization of Photomultiplier Gain of Liquid Scintillation Counter," *Pribory i Tekhnika Eksperimenta*, No. 5, September-October, 1987, pp. 86–87; and Binon, F., et al, "Photomultiplier Gain Tuning System," *Nuclear Instruments and Methods*, Vol. 214, 1983, pp. 269–272.

Additional remote gain-control methods involve changing the voltage electronically between various PMT dynodes. In the Allen ('914) device, the voltage of several intermediate dynodes is adjusted using a transistor circuit. In the Bentley ('972) device, the voltage of one intermediate dynode is adjusted using an optical sensing circuit to hold the PMT output constant for a given pulsed light source. In the Sweeney ('891) device, the voltage at one intermediate dynode is controlled by a transistor controlled with a potentiometer.

Mitsenko, I.D., "Automatic Noise Gain Control Using an FEU-83 Photomultiplier," *Pribory i Tekhnika Eksperimenta*, No. 4, July-August, 1970, pp. 193–194 describes a method wherein the voltage of a PMT modulating electrode is controlled.

In the device disclosed in the Doonan ('817) patent, the voltage across the last pair of dynodes is adjusted by a transistor connected across the dynode bias resistor responsible for controlling the voltage across this dynode pair. In the Chapman ('172) device, PMT gain is controlled by the voltage applied across three dynodes located in the middle of the dynode string.

In the device disclosed by Martyushev, Y. Y., and G. D. Petrukhin, "An Efficient Circuit for the Automatic Regulation of Photomultiplier Sensitivity," *Pribory i Tekhnika Eksperimenta*, No. 1, January-February, 1983, pp. 131–134, the voltage between two intermediate dynodes is regulated by an optically coupled resistor. In the disclosure of Ave yanov, G.A., et al, "Circuit for Automatic Control of Gain of an FEU-83 Photomultiplier According to Noise Level," *Pribory i Tekhnika Eksperimenta*, No. 4, July-August, 1976, pp. 191–192, PMT gain is controlled via magnetic deflection by an electromagnet mounted near the cathode.

In the Farnsworth ('233) device, two independent voltage divider strings are used with each string connected to alternating PMT dynodes. By controlling the supply voltage for each divider string, PMT gain control is affected through changes in dynode electrostatic deflection.

These articles and prior art patents are representative of all known material art which is not cumulative.

Therefore, it is an object of this invention to provide a means for remotely controlling the gain of a PMT wherein only one connection in addition to a circuit ground is required between the remote gain-control circuit and the PMT tube bias circuit.

It is another object of the present invention to provide such a remote gain control for a PMT wherein no high-voltage power supply is required other than the single high-voltage power supply required for PMT bias.

Another object of the present invention is to provide remote gain control circuitry for PMTs which incorporates readily-available, low-cost electronic components.

Still another object of the present invention is to provide PMT remote gain control circuitry wherein PMT gain reduction caused by sagging last-dynode voltage with signal current in standard voltage divider networks is substantially eliminated.

Yet another object of the present invention is to provide remote gain control circuitry for PMTs which may be controlled by a control voltage deriving from a standard digital-to-analog converter circuit.

Another object of the present invention is to provide PMT remote gain control circuitry which yields a PMT gain-control range of approximately four-to-one.

DISCLOSURE OF THE INVENTION

Other objects and advantages will be accomplished by the present invention which serves to remotely control the gain of a photomultiplier tube (PMT) wherein only one connection in addition to a circuit ground is required between the remote gain control circuit and the PMT bias circuit. Moreover, the remote gain control circuitry is designed to be constructed from readily-available, low-cost electronic components, while obviating the need for a high-voltage power supply, above the single supply required for biasing the PMT. Additionally, the use of the regulated control circuit ensures that the control voltage is held substantially constant, independent of the signal current flowing in the PMT, thereby greatly minimizing the problem of PMT gain reduction with signal current caused by voltage drops in the traditional resistive string used to bias PMT dynodes.

The remote gain control circuitry may be used with a PMT having any number of dynodes. The remote gain control circuitry is connected to the last dynode—the dynode nearest to the anode—thus controlling the total dynode supply voltage and influencing the voltage between dynode pairs. As a result, the multiplication gain of all dynodes is affected, except between the first dynode and the cathode when at least one zener diode is connected therebetween in order to regulate that voltage. Thus, a wide range of PMT gain control is available.

In the present invention, a negative high voltage is applied to the cathode, and the anode is biased at circuit ground. A cathode biasing network is connected to the cathode and an anode biasing network is connected to the anode for biasing each respectively to selected voltages. As a result, the last dynode voltage is at a voltage which can be easily adjusted using readily-available, low-cost electronic circuit components. The remote gain control circuit of the present invention includes an integrated-circuit operational amplifier, a high-voltage transistor, and a plurality of resistors, a plurality of capacitors, and a plurality of diodes. Negative feedback is used to set the PMT last dynode voltage proportional to a gain control voltage delivered by a voltage source such as a digital-to-analog converter controlled by a computer.

The control circuitry of the present invention is connected to the PMT last dynode using a single connecting wire. The connecting wire is fabricated from a wire capable of carrying a voltage in the range of the last dynode voltage.

A resistor and a capacitor provide standard lead-lag compensation to ensure frequency stability of the operational amplifier control circuitry. The selection of the resistor and the capacitor, together with other circuit characteristics, determine the frequency and transient response of the remote gain control circuit.

Capacitors are used for standard operational-amplifier power-supply bypassing. A resistor is used for standard operational-amplifier input bias-current compensation. A high-voltage transistor capable of operating at the last dynode voltage is connected to the last dynode of the PMT. A resistor is used to convert the output voltage of the operational amplifier to emitter current in the transistor. A substantial portion of the emitter current flows out the transistor collector of and into the PMT dynode resistive-divider network. A diode is optionally used to prevent reverse bias of the base-emitter junction of transistor during power up or other situations where proper feedback operation may not be established.

Resistors comprise a standard PMT dynode bleeder network, or resistive divider. The first resistor may be replaced with one or more zener diodes to hold a fixed voltage between the cathode and first dynode. A cathode resistor may be optionally used to lower the overall bias voltage of the PMT and thus adjust the PMT gain. In addition to, or in lieu of, the cathode resistor, one or more of the resistive networks may further include a variable resistor (potentiometer) to allow for the adjustable resistivity of the particular resistive network or networks. The adjustable resistive network allows for adjusting the voltage between the particular pair or pairs of dynodes connected by the particular variable resistive network or networks, thereby resulting in the adjustment of the PMT gain. An anode resistor is used for establishing a bias voltage on the anode.

Capacitors are provided for preventing changes in dynode voltages during a PMT output-current pulse. The capacitors are connected in parallel to the resistive network between the last two dynodes and in parallel to at least a portion of the circuitry between the last dynode and the anode biasing network.

Zener diodes are provided to protect the PMT should the remote gain control circuit be un-powered or disconnected. Normally, the zener diodes are non-conducting. The zener diodes limit the maximum last dynode-to-anode voltage that can appear in the PMT.

Although illustrated and described as being connected to the last PMT dynode, it is foreseeable that the control circuit of the present invention may be applied to any selected dynode with appropriate modification being made to the resistive bleeder string associated with the PMT.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
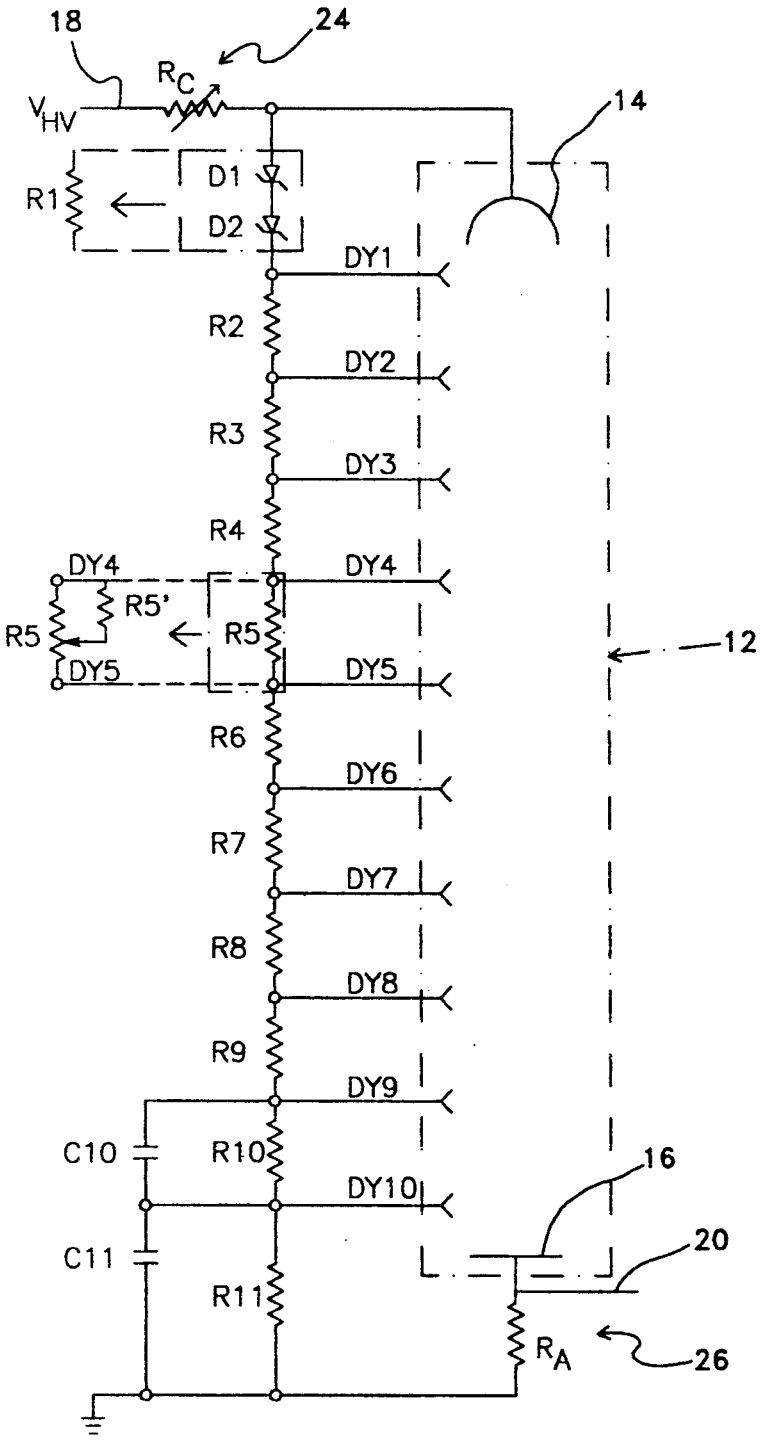
Fig. 1 PRIOR ART
FIG. 1 is a schematic illustration of a photomultiplier tube and a prior art PMT bias circuit.
Figure 2:
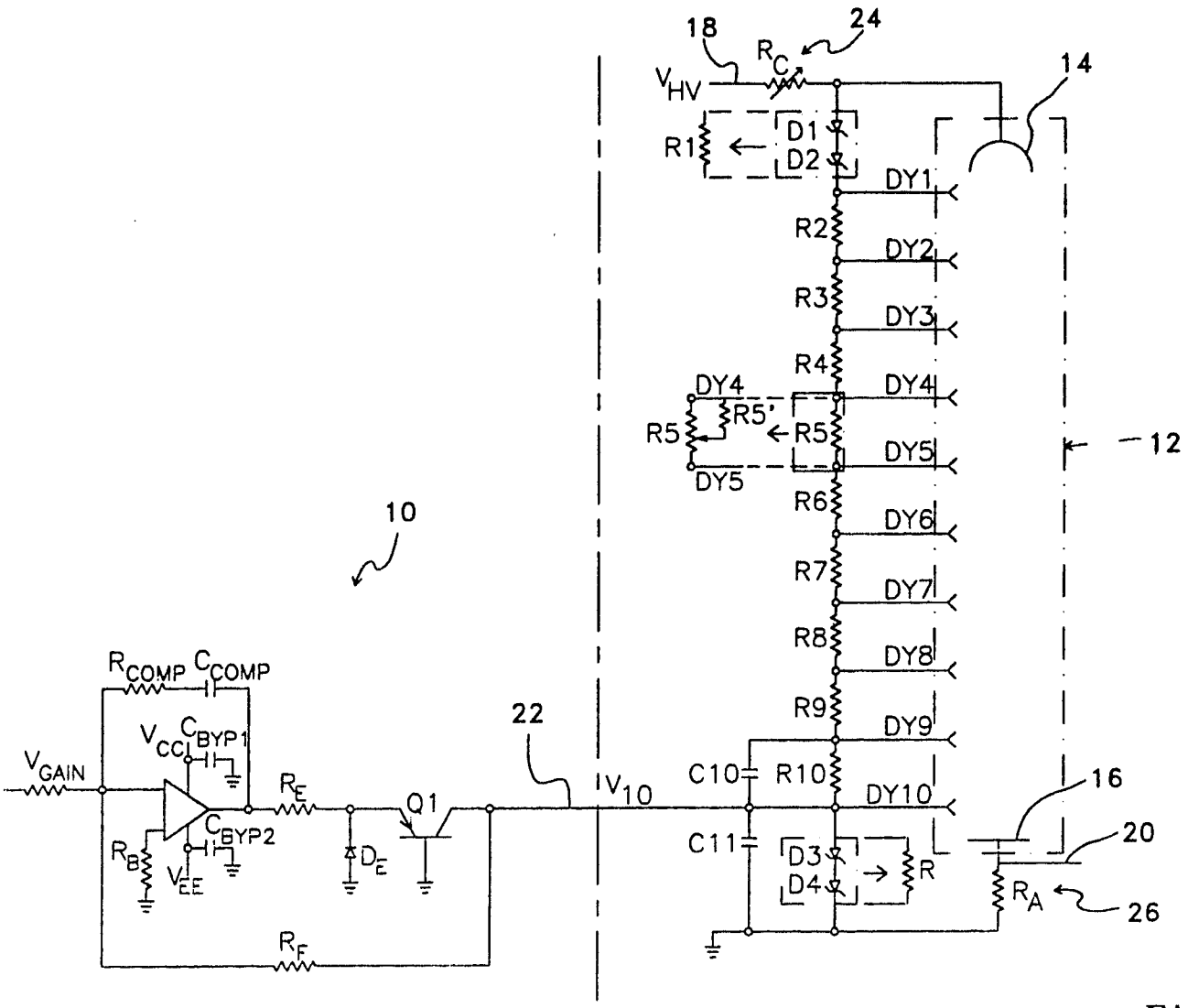
FIG. 2 is a schematic illustration of the remote gain control circuitry for photomultiplier tubes of the present invention.

A remote gain control circuit for photomultiplier tubes (PMTs 12) incorporating various features of the present invention is illustrated generally at 10 in FIG. 2. The remote gain control circuit 10 is designed for remotely controlling the gain of a PMT 12 wherein only one connection in addition to a circuit ground is required between the remote gain control circuit 10 and the PMT bias circuit. Moreover, in the preferred embodiment the remote gain control circuit 10 is designed to be constructed from readily-available, low-cost electronic components, while obviating the need for a high-voltage power supply beyond the one required for PMT bias. Additionally, the use of a regulated control circuit 10 ensures that the control voltage is held substantially constant, independent of the signal current flowing in the PMT 12, thereby greatly minimizing the problem of PMT gain reduction with signal current caused by voltage drops in the traditional resistive string used to bias PMT dynodes DY.

The PMT remote gain control circuit 10 illustrated in FIG. 2 produces a regulated voltage $V_{10}$ at the PMT last dynode DY10. The voltage $V_{10}$ controls the total dynode supply voltage and influences the voltage between each dynode pair. As a result, the multiplication gain of all dynodes DY is affected by the last dynode voltage, $V_{10}$. However, in when zener diodes D1 and D2 are used to stabilize the voltage between the cathode 14 and first dynode DY1, the last dynode voltage $V_{10}$ does not affect the gain of the first dynode DY1. In any event, with or without zener diodes D1 and D2, a wide range of PMT gain control is available.

The voltage between the last dynode DY10 and the anode 16, which is changing as the voltage $V_{10}$ is changed, does not significantly affect PMT gain. PMT gain is controlled by the cathode-to-first-dynode voltage and by the voltage between successive dynode pairs. This is due to fact the that the secondary-emission gain of each dynode DY is controlled by the voltage between that dynode DY and the electrode (dynode DY or cathode 14) that is previous to it (nearer the cathode 14).

The secondary-emission gain associated with each PMT dynode DY is approximated by:

$$G_{dynode}=\alpha V_{dynode}, \quad (1)$$

where $\alpha$ is the secondary-emission gain coefficient and $V_{dynode}$ is the voltage between the dynode DY under evaluation and the electrode (cathode 14 or dynode DY) that is previous to it. PMT gain is the product of the secondary-emission gain associated with each dynode DY. The PMT gain for the present invention is approximated by:

$$G_{pmt}=\alpha^n(V_1-V_c)\,[(V_{10}-V_1)/(n-1)]^{n-1}, \quad (2)$$

where $\alpha$ is the secondary-emission gain coefficient (assumed equal for all dynodes), n is the number of dynodes DY, and $V_1$, $V_c$, and $V_{10}$ is the voltage with respect to ground for the first dynode DY1, cathode 14, and the last dynode DY10 respectively. In Equation (2), equal voltages are assumed across dynode pairs (R2-R10 equal in value).

Although a 10-stage PMT 12 is shown in FIG. 2 and described herein, the operation is similar for an arbitrary number of dynodes DY as illustrated in Equation (2). Further, it will be seen that the present invention may also be implemented in a PMT 12 wherein secondary-emission gain coefficients are not equal for all dynodes and where equal voltages are not achieved across each successive dynode pair. In this respect, Equation (2) may more generally be stated as the product of each of the secondary-emission gain coefficients multiplied by the product of the voltages between each successive pair of dynodes DY.

In a gain control circuit 10 having a 300 V zener diode network consisting of D1 and D2 ($V_1-V_c=300$), no cathode resistance ($R_c=0$), equal voltages across each successive dynode pair (R2=R3=. . . =R10), equal secondary-emission gain coefficients ($\alpha$) for each dynode DY, and a 10-stage PMT 12 (n=10), the PMT gain from Equation (2) is given by:

$$G_{pmt}=\alpha^{10}(300)\ [(V_{10}-(300+V_{HV}))/(10-1)] \quad (3)$$

In Equation (3), $\alpha$ is the secondary-emission gain coefficient, $V_{10}$ is the last-dynode voltage with respect to ground, and $V_{HV}$ is the PMT high-voltage bias voltage with respect to ground. If a secondary-emission gain coefficient ($\alpha$) of 0.04 and high-voltage bias of $-1500$ V is assumed, the PMT gain given by Equation 3 is equal to 23.4 million for a last dynode-voltage of $-75$ V ($V_{10}=-75$ V) and 5.12 million for a last dynode voltage of $-250$ V ($V_{10}=-250$ V). This corresponds to a gain-adjustment range of greater than four-to-one.

Figure 3:
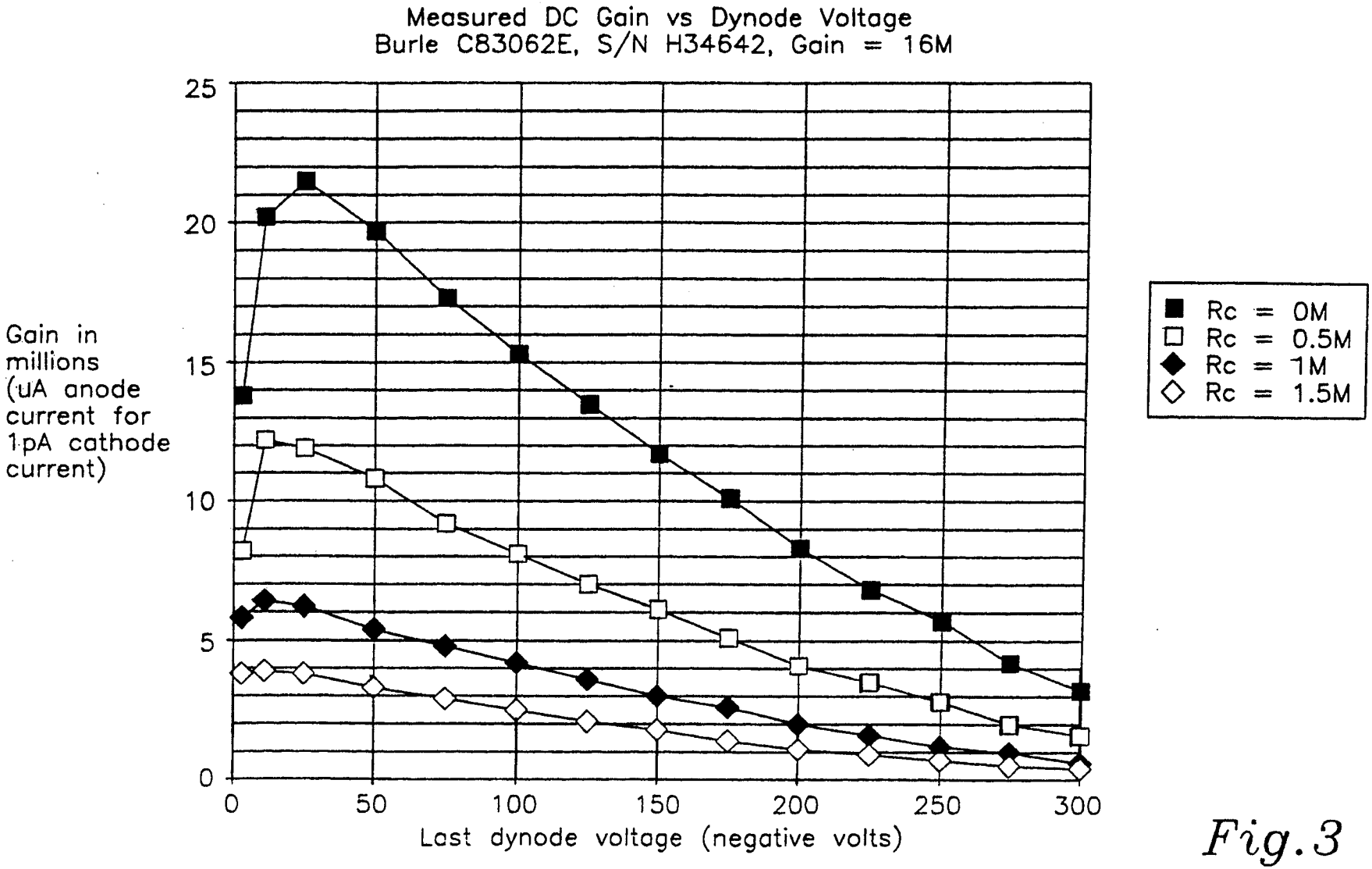
FIG. 3 is a graphical illustration of the direct current gain versus the last dynode voltage derived using the remote gain control circuitry for photomultiplier tubes of the present invention.

FIG. 3 is a graph illustrating the measured gain of a 10-dynode PMT 12 as a function of varying last dynode voltage $V_{10}$. The highest curve illustrates the PMT gain for zero cathode resistance ($R_C=0$ MΩ), and the lowest curve illustrates the PMT gain for cathode resistance of 1.5MΩ ($R_c=1.5$MΩ). A cathode current of 1 pA was used for all gain measurements.

Though not graphically illustrated in FIG. 3, when resistor R5 in the control circuit 10 (or any other resistor in the resistive bleeder string) is adapted with a potentiometer R5', a similar PMT gain graph will result, although the gain graph will be adjusted higher or lower by adjusting the potentiometer R5'. As the resistance associated with the R5-R5' network is decreased, the gain is likewise decreased. Further, as the resistance associated with the R5-R5' network is increased, the gain is increased. Thus, prior methods of adjusting PMT gain by adjusting the voltage between a pair or pairs of dynodes DY or adjusting the total PMT bias voltage by introducing a cathode resistor $R_c$ may be incorporated while allowing the remote gain control circuit 10 of the present invention to serve a fine adjustment.

In FIG. 3, it should be noted that the measured PMT gain drops off sharply for low values of last-dynode voltage due to space charge effects between the last dynode DY10 and the anode 16. It is necessary to maintain sufficient voltage between the last dynode DY10 and anode 16 to avoid space charge limiting, with more voltage required for higher signal currents. Additionally, it is necessary to limit the voltage between the last dynode DY10 and the anode 16 to prevent breakdown in the PMT 12. A practical operating range for the last dynode voltage $V_{10}$ for the PMT 12 considered in the measurements is $-75\ V<V_{10}<-250$ V.

Adjusting the cathode resistance $R_c$ and the last dynode voltage $V_{10}$ causes a transit-time shift in the PMT 12 shown in FIG. 2 due to changes in electron velocity caused by changes in internal electric fields. Measurements for the PMT 12 considered in FIG. 3 indicate that transit time increases approximately 1 ns for a last dynode voltage $V_{10}$ change of $-75$ V to $-250$ V for any fixed value of cathode resistance $R_c$ between 0 and 1.5MΩ. PMT transit time increases approximately 3 ns for a fixed value of last-dynode voltage $V_{10}$ for cathode resistance $R_c$ increasing from 0 to 1.5MΩ. The nominal transit-time for the PMT 12 considered in FIG. 3 is 22 ns for the PMT 12 operating at a nominal gain setting for a total bias voltage of $-1500$ V. Transit-time shift with PMT gain setting must be considered for certain system applications, e.g., in scintillation-detector timing applications.

In the PMT bias circuit shown in FIG. 2, a negative high voltage $V_{HV}$ is applied to the cathode 14, and the anode 16 is biased at circuit ground. To accomplish this, a cathode biasing network 24 may be connected to the cathode 14. Further, an anode biasing network 26 is connected to the anode 16 for biasing the anode 16 at a selected voltage. As a result, in the illustrated example of the preferred embodiment, the last dynode voltage $V_{10}$ is at a voltage in the general range of $-75$ V to $-250$ V which can be easily adjusted using readily-available, low-cost electronic circuit components. The operating voltage range of the last dynode DY10 will vary with specific PMTs 12.

The remote gain control circuit 10 of the present invention is used to regulate the PMT last dynode voltage $V_{10}$. This circuit includes an integrated-circuit operational amplifier U1, a high-voltage transistor Q1, and a plurality of resistors $R_B$, $R_E$, $R_F$, $R_G$, $R_{COMP}$, a plurality of capacitors $C_{BYP1}$, $C_{BYP2}$, $C_{COMP}$, and a diode $D_E$. Negative feedback is used to set the last dynode voltage $V_{10}$ at a voltage controlled by the gain control voltage $V_{GAIN}$. $V_{GAIN}$ may be delivered from a digital-to-analog converter (not shown), which may be controlled by a computer (not shown).

The control circuit 10 of the present invention is connected to the PMT last dynode DY10 using a single connecting wire 22. The connecting wire is fabricated from a wire capable of carrying a voltage in the range of the last dynode voltage $V_{10}$. In the example shown in FIG. 2, the connecting wire 22 is capable of carrying a voltage load of $-75$ V to $-250$ V.

The last dynode voltage is well approximated by $$V_{10}=-(R_F/R_G)V_{GAIN}, \quad (4)$$

where $R_F$ is the feedback resistance, $R_G$ is the series input resistor, and $V_{GAIN}$ is the gain-control input voltage. The control circuit 10 operates as an inverting direct current (DC) amplifier converting a small control voltage such as in the range of 0.75 V to 2.5 V delivered from the D-to-A converter to a much larger, negative voltage such as in the range of $-75$ V to $-250$ V, as in the above illustrated embodiment. If a last dynode voltage $V_{10}$ of $-100$ V is required, and if $R_F/R_G=100$, then a $V_{GAIN}$ of 1 V would be necessary.

Resistor $R_{COMP}$ and capacitor $C_{COMP}$ provide standard lead-lag compensation to ensure frequency stability of the operational amplifier U1 control circuitry. The selection of $R_{COMP}$ and $C_{COMP}$, together with other circuit characteristics, determine the frequency and transient response of the remote gain control circuit 10.

Capacitors $C_{BYP1}$ and $C_{BYP2}$ are used for standard operational-amplifier power-supply bypassing. Resistor $R_B$ is used for standard operational-amplifier input bias-current compensation. It is foreseeable that $R_B$ may be replaced with a short circuit for operational amplifiers having sufficiently low input-bias currents.

Transistor Q1 is a high-voltage transistor capable of operating at the last dynode voltage $V_{10}$ of the PMT 12. Since the last dynode voltage $V_{10}$ of the illustrated embodiment is in the range of $-75$ V to $-250$ V, and the dynode resistive bleeder current is typically under 250 μA, transistor Q1 can be a low cost, small-signal, high-voltage bipolar transistor. A MOSFET transistor, though not shown, may be used in lieu of the transistor Q1.

Resistor $R_E$ is used to convert the output voltage of the operational amplifier U1 to emitter current in transistor Q1. A substantial portion of the emitter current flows out the collector of Q1 and into the PMT dynode resistive-divider network. Diode $D_E$ is optionally used to prevent reverse bias of the base-emitter junction of transistor Q1 during power up or other situations where proper feedback operation may not be established.

In the circuit of FIG. 2, resistors R1–R10 comprise a standard PMT dynode bleeder network, or resistive divider. As shown in FIG. 2, resistor R1 may be replaced with one or more zener diodes D1, D2 to hold a fixed voltage between the cathode and first dynode DY1. As discussed previously, a cathode resistor $R_c$ may be optionally used to lower the overall bias voltage of the PMT 12 and thus adjust the PMT gain. Also as previously discussed, in addition to, or in lieu of, the cathode resistor $R_c$, one or more of the resistive networks may be provided with a potentiometer, such as potentiometer R5', to allow for the adjustable resistivity of the particular resistive network or networks R. The adjustable resistive network R' allows for adjusting the voltage between the particular pair or pairs of dynodes DY connected by the particular resistive network or networks R, thereby resulting in the adjustment of the PMT gain. An anode resistor $R_A$ is used for establishing a bias voltage on the anode 16.

Capacitors C10 and C11 are provided for preventing changes in dynode voltages V during a PMT output-current pulse. Capacitor C10 is connected in parallel to the resistive network R10 between the last two dynodes DY9, DY10 and the capacitor C11 is connected in parallel to at least a portion of the circuitry between the last dynode DY10 and the anode biasing network 26.

Zener diodes D3, D4 are provided to protect the PMT 12 should the remote gain control circuit 10 be un-powered or disconnected. Normally, the zener diodes D3, D4 are non-conducting. The zener diodes D3, D4 limit the maximum last dynode-to-anode voltage $V_{10}$ that can appear in the PMT 12.

From the foregoing description, it will be recognized by those skilled in the art that a control circuit 10 for remotely controlling the gain of a PMT 12 offering advantages over the prior art has been provided. Specifically, the remote gain control circuit 10 may be adapted to a PMT 12 using a single connection 22 in addition to a circuit ground. Further, in the control circuit 10 of the present invention, only low power-supply voltages are required to operate the integrated-circuit operational amplifier gain control circuit 10, thereby obviating the need for a separate high-voltage power supply beyond the single power supply required for the operation of the PMT 12. Readily-available, low-cost electronic components may be used to construct the remote gain control circuit 10 be of the present invention. The control circuit 10 of the present invention substantially eliminates PMT gain reduction at high PMT output currents by regulating the last dynode voltage $V_{10}$ with a negative feedback circuit. The remote gain control circuit 10 is controlled by a control voltage that can come from standard digital-to-analog converter circuits.

Although illustrated and described as being connected to the last PMT dynode, it is foreseeable that the control circuit 10 of the present invention may be applied to any selected dynode DY with appropriate modification being made to the resistive bleeder string associated with the PMT 12.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A circuit for precisely controlling the gain of a photomultiplier tube, said photomultiplier tube including a plurality of electrodes, said plurality of electrodes including a cathode, an anode, and a plurality of dynodes connected between said cathode and said anode, a first of said plurality of dynodes being nearest said cathode, a last of said plurality of dynodes being nearest said anode, a cathode biasing network being connected to said cathode, an anode biasing network being connected to said anode, a photomultiplier tube biasing voltage being applied between said cathode and said anode biasing network, said circuit comprising:

a plurality of resistive networks for controlling gain between successive pairs of said plurality of electrodes, said plurality of resistive networks being connected in series, at least one each of said resistive networks being connected between successive pairs of said plurality of dynodes; and an active control circuit connected to said last of said plurality of dynodes for controlling said gain at least between each successive pair of said plurality of dynodes in order to precisely control said gain of said photomultiplier tube at a predetermined level, said active control circuit consisting of a negative feedback circuit for regulating a voltage at said last of said plurality of dynodes, said negative feedback circuit including at least a high-voltage transistor powered by photomultiplier tube bias network.

2. The circuit of claim 1 wherein said cathode is biased at a selected voltage, wherein said voltage increases at each successive dynode, and wherein said voltage is most positive at said anode.

3. The circuit of claim 2 wherein said cathode is biased at a negative voltage and said anode is biased to a ground voltage.

4. The circuit of claim 1 further comprising at least a first capacitive network and a second capacitive network, said first capacitive network being connected in parallel to said resistive network connected between said last of said plurality of dynodes and one of said plurality of dynodes immediately previous to said last of said plurality of dynodes, said second capacitive network being connected between said last of said plurality of dynodes and said anode biasing network, said first capacitive network and said second capacitive network being provided for regulating said gain during pulse output of said photomultiplier tube.

5. The circuit of claim 1 wherein said active control circuit is connected to said last of said plurality of dynode with a single connection.

6. The circuit of claim 1 wherein each of said plurality of resistive networks includes at least one resistive element.

7. The circuit of claim 1 wherein at least one of said plurality of resistive networks includes a variable resistor.

8. The circuit of claim 1 further comprising a resistive network connected between said cathode and said first of said plurality of dynodes, said resistive network including at least one resistive element.

9. The circuit of claim 1 wherein at least one zener diode is connected between said cathode and said first of said plurality of dynodes, said at least one zener diode being provided for maintaining a predetermined gain between said cathode and said first of said plurality of dynodes.

10. The circuit of claim 1 further comprising a resistive network connected between said last of said plurality of dynodes and said anode biasing circuit, said resistive network including at least one resistive element.

11. The circuit of claim 1 wherein at least one zener diode is connected between said last of said plurality of dynodes and said anode biasing network.

12. The circuit of claim 1 further comprising a variable resistor connected between said photomultiplier tube biasing voltage and said cathode.

13. A circuit for precisely controlling the gain of a photomultiplier tube, said photomultiplier tube including a plurality of electrodes, said plurality of electrodes including a cathode, an anode, and a plurality of dynodes connected between said cathode and said anode, a first of said plurality of dynodes being nearest said cathode, a last of said plurality of dynodes being nearest said anode, a cathode biasing network being connected to said cathode, an anode biasing network being connected to said anode, a photomultiplier tube biasing voltage being applied between said cathode and said anode biasing network, said cathode being biased at a selected voltage, said voltage increasing at each successive dynode, and wherein said voltage is most positive at said anode, said circuit comprising:

a plurality of resistive networks for controlling gain between successive pairs of said plurality of electrodes, said plurality of resistive networks being connected in series, at least one each of said resistive networks being connected between successive pairs of said plurality of dynodes, each of said plurality of resistive networks including at least one resistive element; and an active control circuit connected to said last of said plurality of dynodes for controlling said gain at least between each successive pair of said plurality of dynodes in order to precisely control said gain of said photomultiplier tube at a predetermined level, said active control circuit consisting of a negative feedback circuit for regulating a voltage at said last of said plurality of dynodes, said negative feedback circuit including at least a high-voltage transistor powered by said photomultiplier tube bias network.

14. The circuit of claim 13 wherein said active control circuit is connected to said last of said plurality of dynode with a single connection.

15. The circuit of claim 13 wherein at least one of said plurality of resistive networks includes a variable resistor.

16. The circuit of claim 13 further comprising a resistive network connected between said cathode and said first of said plurality of dynodes, said resistive network including at least one resistive element.

17. The circuit of claim 13 wherein at least one zener diode is connected between said cathode and said first of said plurality of dynodes, said at least one zener diode being provided for maintaining a predetermined gain between said cathode and said first of said plurality of dynodes.

18. The circuit of claim 13 further comprising a resistive network connected between said last of said plurality of dynodes and said anode biasing circuit, said resistive network including at least one resistive element.

19. The circuit of claim 13 wherein at least one zener diode is connected between said last of said plurality of dynodes and said anode biasing network.

20. The circuit of claim 13 further comprising a variable resistor connected between said photomultiplier tube biasing voltage and said cathode.

21. The circuit of claim 13 further comprising at least a first capacitive network and a second capacitive network, said first capacitive network being connected in parallel to said resistive network connected between said last of said plurality of dynodes and one of said plurality of dynodes immediately previous to said last of said plurality of dynodes, said second capacitive network being connected between said last of said plurality of dynodes and said anode biasing network, said first capacitive network and said second capacitive network being provided for regulating said gain during pulse output of said photomultiplier tube.

* * * * *

UNITED STATES PATENT AND TRADEMARK OFFICE

CERTIFICATE OF CORRECTION

PATENT NO. : 5,367,222

DATED : November 22, 1994

INVENTOR(S) : David M. Binkley

It is certified that error appears in the above-identified patent and that said Letters Patent is hereby corrected as shown below:

On the cover page, item [73], the Assignee should be corrected from "CTI Pet Systems, Inc." to read --CTI PET Systems, Inc.--.

On column 6, line 41, in equation (2), the superscript"alpha" should be a lower case "alpha" positioned on the baseline, and specifically, "$\alpha n$" should read --$\alpha^n$--.

Signed and Sealed this

Eighth Day of August, 1995

*Attest:*

Bruce Lehman

BRUCE LEHMAN

*Attesting Officer*

*Commissioner of Patents and Trademarks*